US006397897B2

(12) United States Patent
Fumex

(10) Patent No.: US 6,397,897 B2
(45) Date of Patent: Jun. 4, 2002

(54) CONNECTOR FOR A HEDDLE FRAME IN A WEAVING LOOM

(75) Inventor: André Fumex, Talloires (FR)

(73) Assignee: Staubli Faverges, Faverges (FR)

( * ) Notice: Subject to any disclaimer, the term of this patent is extended or adjusted under 35 U.S.C. 154(b) by 0 days.

(21) Appl. No.: 09/965,892

(22) Filed: Oct. 1, 2001

(30) Foreign Application Priority Data

Oct. 6, 2000 (FR) ..... 00 12841

(51) Int. Cl.[7] ..... D03C 9/00; D03C 1/14
(52) U.S. Cl. ..... 139/57
(58) Field of Search ..... 139/57

(56) References Cited

U.S. PATENT DOCUMENTS 3,074,438 A * 1/1963 Svaty ..... 139/57
4,365,653 A 12/1982 Freisler et al.
4,369,815 A 1/1983 Gehring et al.
4,541,459 A 9/1985 Palau
4,715,409 A 12/1987 Graf
5,518,040 A 5/1996 Rupflin
5,810,055 A * 9/1998 Haeussler et al. ..... 139/57

FOREIGN PATENT DOCUMENTS

EP 0117826 9/1984
FR 2408672 6/1979

* cited by examiner

*Primary Examiner*—Andy Falik
(74) *Attorney, Agent, or Firm*—Dowell & Dowell, P.C.

(57) ABSTRACT

A device for connecting a heddle frame to a reciprocating lever in a weaving loom which device includes a hook defining a housing in which a ring is selectively seated. The ring is mounted to either the heddle frame or the lever and includes surfaces for cooperatively engaging bearing surfaces defined by the housing of the hook. A lock is provided which is pivotally mounted to the hook and is engageable to retain the ring within the housing of the hook.

11 Claims, 5 Drawing Sheets

CONNECTOR FOR A HEDDLE FRAME IN A WEAVING LOOM

BACKGROUND OF THE INVENTION

1. Field of the Invention

The present invention relates to a device for hooking between a heddle frame and a lever actuated by a weave system. It also relates to a weaving loom equipped with such a device.

2. Description of the Related Art

In order to simply the operations of mounting and dismantling of the heddle frames on a weaving loom, it is known to use connecting devices arranged to ensure, semi-automatically, the hooking and unhooking of the frames with respect to the levers of the system. Such a device is disclosed in EP-A-0 117 826 in which an open hook is configured to cooperate with a polygonal ring, this hook being provided with two plates forming a catch for locking the ring. These plates are arranged on either side of an arm of the hook on which they are articulated. Each plate has a relatively small thickness and the arm on which they are articulated must also present a relatively small thickness with respect to the rest of the hook and with respect to the width of the ring, in order to allow these plates to align with the ring. Due to the small thickness of the plates, the contact surfaces of these plates and of the ring are relatively reduced, which, taking into account the usual vibrations in a weaving loom, leads to premature wear of the plates and/or of the ring. In addition, the pivot pin of the plates on the hooks also tends to wear out due to these vibrations. Furthermore, a traction spring is provided for exerting on the plates an effort tending to return them towards a position of locking of the ring. Such a spring tends to wear out and may break at the level of its attachments on the hook and/or on an element fast with the plates. Finally, rivets must be provided for assembling the plates together and on the hook, such rivets having to be positioned with care, which reduces productivity of a method for manufacturing such a device. These drawbacks limit the performances of a loom equipped with devices of this type.

It is a more particular object of the invention to overcome these drawbacks by proposing a hooking device which is as easy to use as that of the prior state of the art and in which the risks of premature wear are substantially reduced.

SUMMARY OF THE INVENTION

To that end, the invention relates to a device for hooking between a heddle frame and a lever actuated by a weave system, this device comprising a ring of substantially polygonal section, fast with the frame or with the lever, and an open hook, provided with bearing surfaces arranged to cooperate with the section of the ring and fast with the lever or the frame, certain of these bearing surfaces being parallel to one another and adapted to ensure, by cooperation with two surfaces of the ring likewise parallel to one another, the essential of the transmission of effort between the lever and the heddle frame, while the hook is equipped with a member for locking the ring in position engaged in the hook, the bearing zone of the locking member against the ring being located substantially between an axis of articulation of the ring on the frame or on the lever and an axis of articulation of the locking member on the hook, characterized in that the locking member is constituted by a lock forming a pivot pin received in a cavity formed in the thickness of the hook, this lock presenting a surface adapted to interact with the ring and of width substantially equal to the width of the ring.

Thanks to the invention, the lock can bear on the polygonal ring over substantially the whole width of this ring, which substantially increases the area of contact with respect to the known devices. The fact that the lock forms a pivot pin received in a cavity of the hook avoids having to use an added pin, such as a rivet, and induces an efficient transmission of effort between the lock and the hook. The fact that the bearing zone of the lock against the ring is located substantially between the axes of articulation of the ring and of the lock, means that the lock works essentially in compression, which enables it to be particularly efficient. In addition, as the essential of the efforts transmitted by the lever to the frame passes through the bearings and the parallel surfaces provided respectively on the hook and on the ring, the lock is not under permanent strain.

According to advantageous aspects of the invention, the device incorporates one or more of the following characteristics:

The lock is made of self-lubricating steel, for example a sintered steel. This makes it possible to limit the frictions at the level of the surfaces of the lock and the ring in contact and at the level of the contact surfaces of the pin and the cavity in which it is received.

The lock and the hook together define a volume for receiving a compression spring, this volume, defined in the thickness of the lock and the hook, being of variable size as a function of the relative position of the lock and of the hook. Thanks to this aspect of the invention, the spring does not present attachments likely to break and may be protected from the outside environment.

A maneuvering member is clipped on the lock and comprises a tab on which a user may exert an effort or force for controlling the pivoting of the lock with respect to the hook.

An element for containment of a volume defined between the hook and the lock comprises two cheeks disposed on either side of the hook and the lock. This containment element makes it possible to isolate the aforementioned volume and, if necessary, the spring that it contains. Reserves of grease may be provided in the cavities formed between the lock and the hook, particularly in the vicinity of the pin. It may thus be envisaged to force-feed lubricant in the zone of articulation between the lock and the pin. The containment also makes it possible to protect the zones full of grease from pollution such as flock. In that case, the containment element is advantageously constituted by the maneuvering member which is constituted by a plastic part. In addition, the maneuvering member may be provided to form a pin extending between the aforementioned cheeks and adapted to pivot in a cavity formed in the thickness of the lock.

The maneuvering member forms a beak for elastically clipping on a concave part of the lock oriented opposite that surface of the lock provided to interact with the ring. This mode of fixation of the maneuvering member on the lock allows a rapid and reliable assembly while providing a possibility of dismantling, particularly for fresh lining of grease along the internal cavities of the device.

The ring is equipped with an integrated lubricator, this ring and this lubricator being made in one piece, of plastics material. The lubricator may be mobile between two positions, oriented at 180° with respect to each other about the central axis of the ring, while the plates for connecting the ring to the frame on which it is mounted may be stamped with a setback at the level of the edge of the ring, with the result that the width of the ring may be increased without substantially increasing the overall dimensions of the device.

The ring bears an element in relief for indexing, adapted to cooperate with at least one plate of a pair of plates between which the ring is mounted, with the result that the angular clearance of the ring with respect to these plates is limited.

The invention also relates to a weaving loom equipped with a hooking device as described hereinbefore. Such a weaving loom is easier to use than those of the prior state of the art, while its maintenance is facilitated and the life of the devices that it comprises is substantially increased over that of known looms. The performances of such a loom are substantially improved with respect to those of the prior art looms.

BRIEF DESCRIPTION OF THE DRAWINGS

The invention will be more readily understood on reading the following description of an embodiment of a hooking device in accordance with its principle, given solely by way of example and made with reference to the accompanying drawings, in which.

DESCRIPTION OF PREFERRED EMBODIMENT

Figure 1:
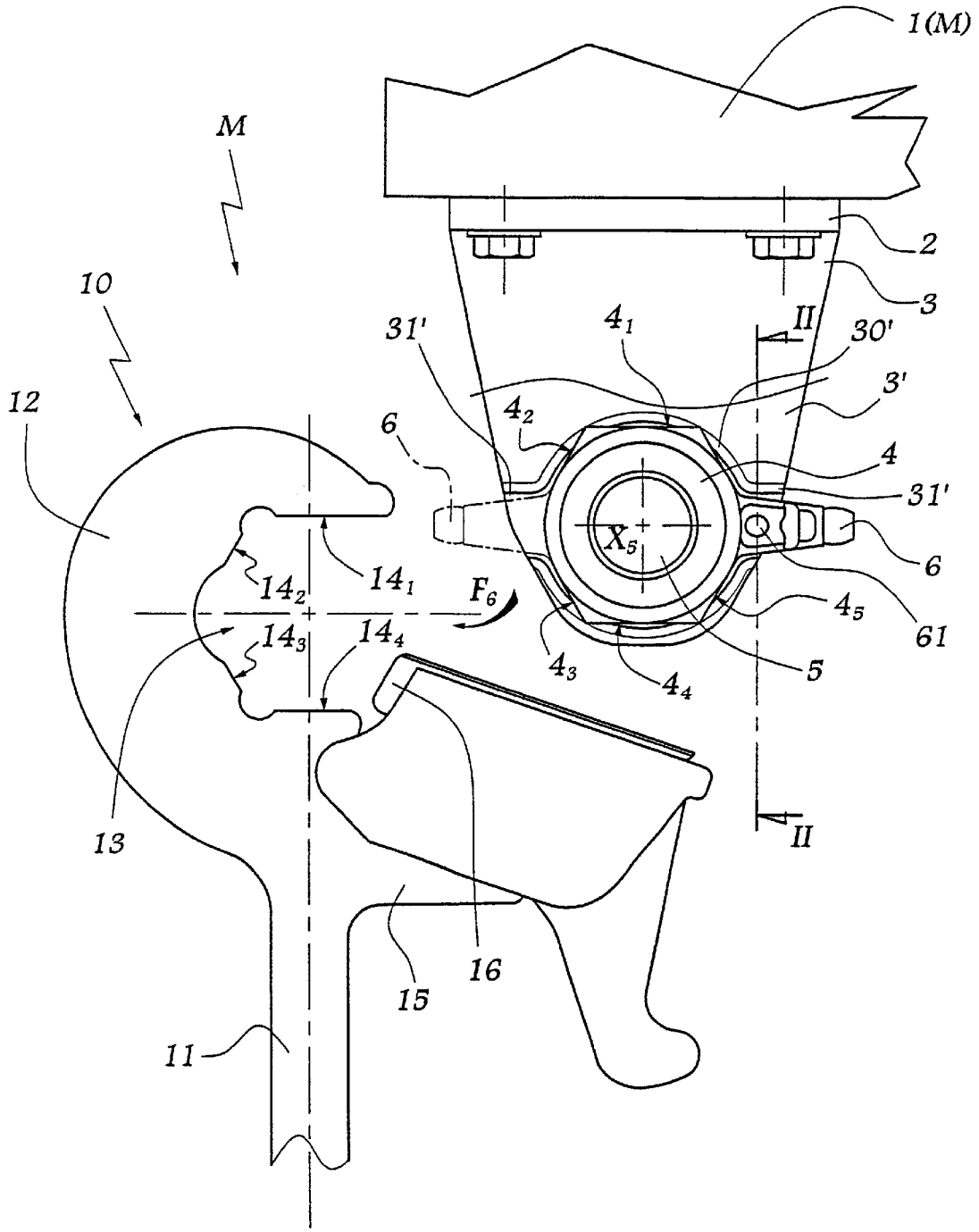
FIG. 1 is a side view with parts torn away at the level of the ring of a hooking device according to the invention before the hook is hooked on the polygonal ring.

Referring now to the drawings, a heddle frame 1 of a weaving loom is represented by its lower upright in the Figures and constitutes a part of a weaving loom M.

On this frame 1 are mounted, by means of a bar 2, two plates 3 and 3' between which is arranged a ring 4 of substantially hexagonal section. The ring 4 presents a metal pin 5 crimped on the plates 3 and 3'. The ring 4 is moulded from self-lubricating plastics material.

The ring 4 is in one piece with a lubricator 6 for force-feeding the zone of contact between the ring 4 and the pin 5 with a lubricant. It is noted that the ring 4 may rotate about pin 5, with the result that the lubricator 6 may be disposed in the position shown in solid lines or in the position shown in broken lines in FIG. 1, depending on the scheduled direction of cooperation with a hook.

Figure 2:
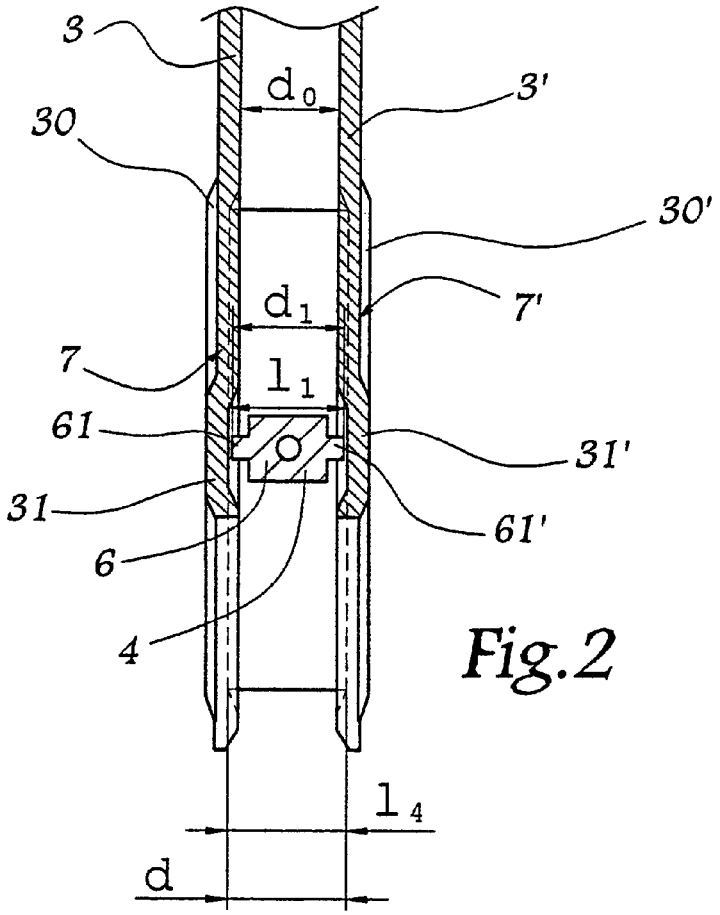
FIG. 2 is a section on a larger scale along line II—II of FIG. 1.
Figure 6:
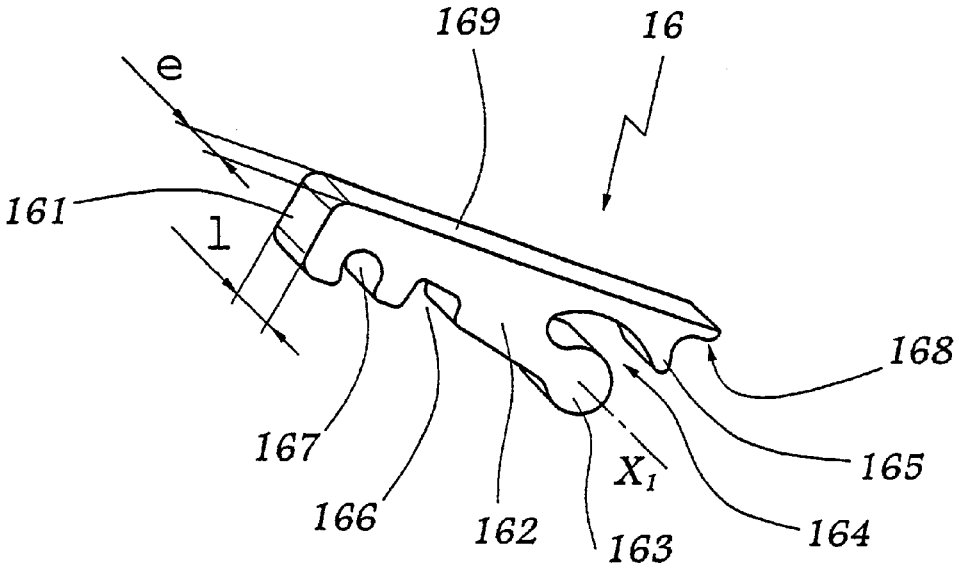
FIG. 6 is a view in perspective of the lock of the device of FIGS. 1 to 5.

As is more clearly visible in FIG. 2, the plates 3 and 3' are stamped at the edges of the ring 4, with the result that they form zones 7 and 7' separated by a distance d greater than the distance $d_0$ separating the plates 3 and 3' at their joint with the bar 2. The width 14 of the ring 4, which is substantially equal to the distance d, is thus greater than the distance $d_0$ which is linked with the width of the head 12.

The ring 4 is partially engaged in two stamped portions 30 and 30' respectively forming the zones 7 and 7' on the plates 3 and 3' and defining therebetween the volume for receiving the ring 4.

The lubricator 6 is provided with two lateral studs 61 and 61' intended to be engaged in lateral extensions 31 and 31' of the stamped portions 30 and 30'. The extensions 31 and 31' form grooves for receiving the studs 61 and 61' facing towards the centre of the volume defined between these plates.

The studs 61 and 61' are in one piece with the lubricator 6 and the ring 4.

At the level of the extensions 31 and 31", the distance $d_1$ between the plates 3 and 3' is equal to the distance d and greater than width $\mathbf{1}_1$ of the lubricator 6 at the level of the studs 61 and 61'. In this way, the studs may be displaced in the width of the extensions 31 and 31' without rubbing against the plates, this allowing a limited angular clearance of the ring 4 about the geometrical axis $X_5$ of the pin 5. When it is desired to tilt the ring 4 from the position represented in solid lines to the one represented in broken lines in FIG. 1, the studs 61 and 61' are slid, by means of an effort allowing the studs 61 and 61' to be extracted from the extensions 31 and 31', against the opposite surfaces of the plates 3 and 3' outside the stamped portions 30 and 30', so as to bring them in those parts of the extensions 31 and 31' located to the left of FIG. 1, only deformation 31' being visible in this Figure. A movement in the opposite direction remains, of course, possible.

The lubricator 6 might, of course, bear only one stud, the two plates 3 and 3' being able to remain identical in order to simplify manufacture of the device. One sole stud cooperating with one sole extension suffices, in fact, to limit the angular clearance of the ring 4.

A hook 10 is in one piece with or welded on a lever 11 actuated by a weave system such as a dobby. The hook 10 comprises a head 12 defining a housing 13 for receiving the ring 4, the housing 13 being bordered by surfaces $\mathbf{14}_1$, $\mathbf{14}_2$, $\mathbf{14}_3$ and $\mathbf{14}_4$ adapted to come respectively into engagement with surfaces $\mathbf{4}_1$, $\mathbf{4}_2$, $\mathbf{4}_3$ and $\mathbf{4}_4$ of the edge of the ring 4.

Figure 3:
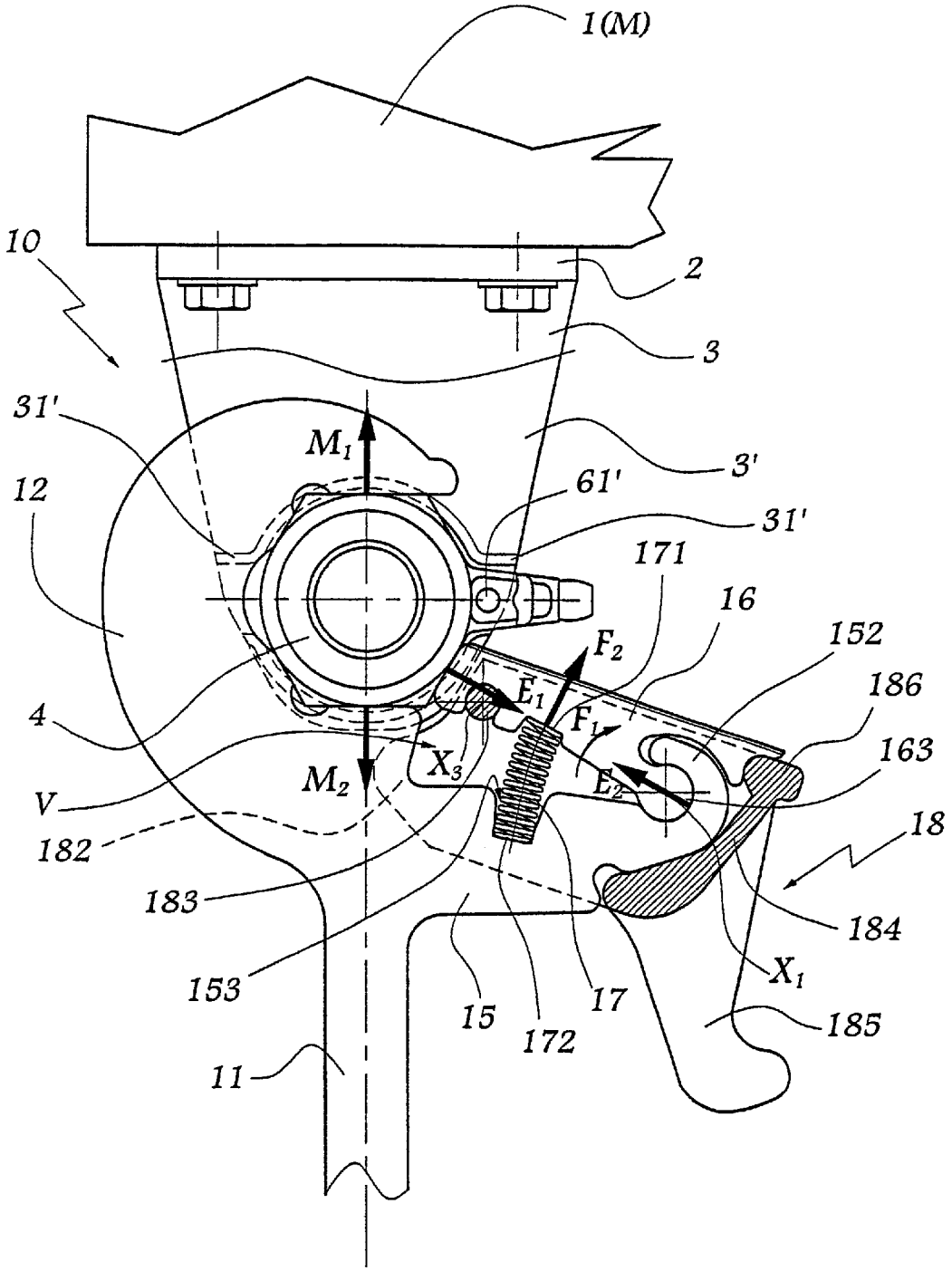
FIG. 3 is a view similar to FIG. 1, with additional parts torn away at the level of the hook, while the hook is in place on the ring.
Figure 4:
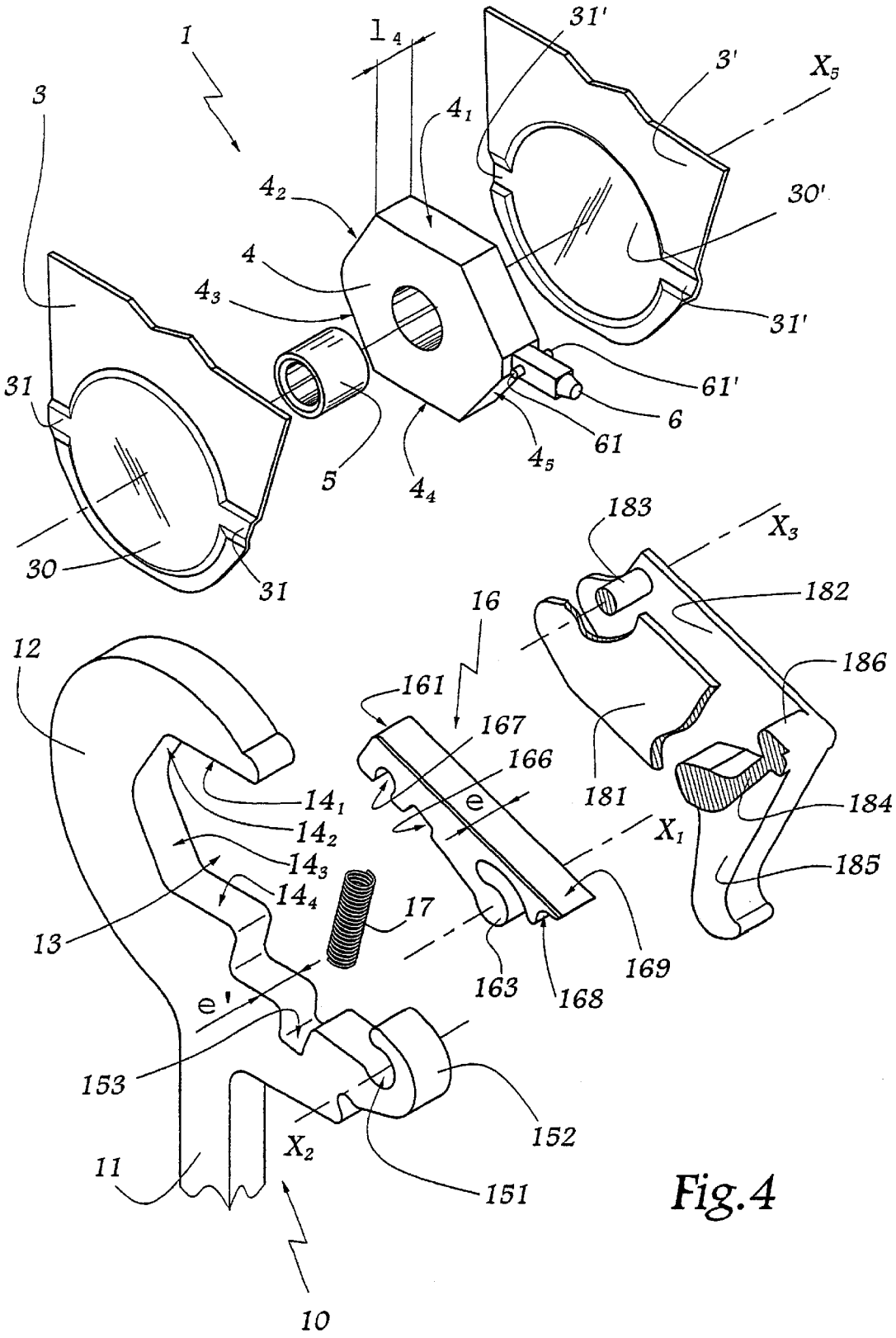
FIG. 4 is an exploded view in perspective of certain elements constituting the device of FIGS. 1 to 3.

The efforts for placing the frame 1 in motion are substantially perpendicular to the bearing surfaces $\mathbf{14}_1$, and $\mathbf{14}_4$ and to surfaces $\mathbf{4}_1$ and $\mathbf{4}_4$, as represented by the arrows of movement $M_1$, and $M_2$ in FIG. 3. Taking into account the geometry of the bearing surfaces $\mathbf{14}_1$, and $\mathbf{14}_4$ and of surfaces $\mathbf{4}_1$, and $\mathbf{4}_4$ which are parallel to one another, the efforts for placing the frame 1 in motion essentially transit via these bearing surfaces and surfaces. In particular, the ring 4 does not tend to be driven from the housing 13.

Figure 5:
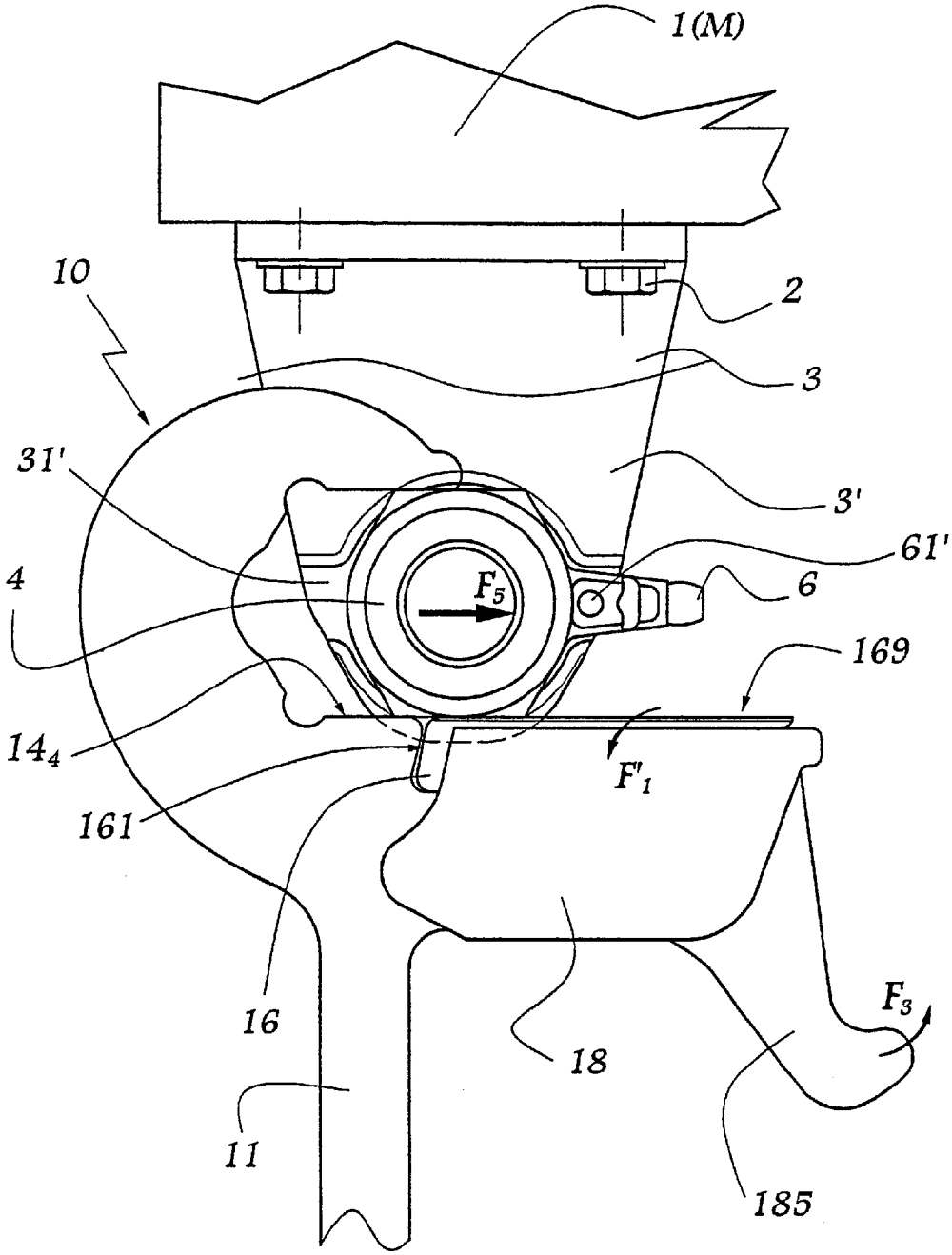
FIG. 5 is a view similar to FIG. 1 while the device is in another configuration of use.

As the ring 4 may have a certain angular clearance about axis $X_5$, the surfaces $\mathbf{4}_1$, and $\mathbf{4}_4$ may remain perpendicular to the efforts $M_1$, and $M_2$, including in the case of the lever 11 tending to oscillate perpendicularly to the vertical in the plane of FIGS. 1, 3 and 5.

The hook 10 is also provided with an arm 15 on which is mounted a lock 16 enabling the ring 4 to be retained in the configuration of FIG. 3.

The lock 16 comprises a surface 161 intended to come into contact with a lateral surface $\mathbf{4}_5$ of the ring 4, the surface 161 having a width 1 substantially equal to the thickness e of the lock 16 which is itself substantially equal to the thickness e' of the metal sheet from which the hook 10 is cut out. In practice, the width 1 is substantially equal to, and preferably slightly smaller than, the width $\mathbf{1}_4$. A surface bearing of the surfaces 161 and $\mathbf{4}_5$ is possible over the area of the surface 161.

The lock 16 comprises a tab 162 whose end 163 presents a partially cylindrical outer section, with the result that it may constitute a pivot pin in a cavity 151 made in the thickness e' of the arm 15 and presenting a partially cylindrical shape.

$X_1$, denotes the geometrical axis of the end 163 and $X_2$ the geometrical axis of the cavity 151. When the lock 16 is mounted on the arm 15, the axes $X_1$ and $X_2$ merge and the end 163 forms a pivot pin on the hook 10, this pin being in one piece with the lock 16.

As is more particularly visible in FIG. 3, when the ring 4 is in place in the housing 13, the zone of abutment of the lock 16 on the ring 4, i.e. the zone including the surfaces 161 and $4_5$, is located approximately between axes $X_5$ and $X_1$. In this position, the lock 16 therefore works essentially in compression, as represented by arrows $E_1$ and $E_2$ which figure the efforts undergone by the lock 16 respectively from the ring 4 and the hook 10.

As the ring 4 does not tend to be driven from the housing 13 under the effect of the setting in motion $M_1$ and $M_2$, the lock 16 does not intervene systematically to counter the efforts of effort transmission but principally to ensure the relative engaged position of the hook and of the ring against the vibratory movements and the possible obliqueness of the hook. The lock 16 is therefore hardly stressed and the fact that it works in compression is very favourable from the mechanical standpoint in order to obtain an efficient locking of the ring 4 in the housing 13.

The arm 15 forms a return 152 around the cavity 151 while a slot 164 is defined between the tab 162 and a rear part 165 of the lock 16 opposite the surface 161. The geometry of the elements 152 and 164 is such that, when the lock 16 is in mounted configuration, the return 152 is engaged inside the slot 164. The geometry of these elements limits a movement of tilting of the lock 16 about axes $X_1$ and $X_2$ in the trigonometric direction opposite to FIG. 3, i.e. in the direction of arrow $F_1$.

The lock 16 defines a housing 166 for receiving one end 171 of a compression spring 17 of which the second end 172 is received in a housing 153 provided on the arm 15. The housings 171 and 172 are formed in the thickness of the opposite edges of the elements 15 and 16. The spring 17 is dimensioned such that it permanently exerts on the lock 16 an effort represented by arrow $F_2$ tending to tilt the lock 16 in the direction of arrow $F_1$ in FIG. 1.

A maneuvering member 18 is formed by a piece made of molded plastic material which essentially comprises two plates 181, 182 connected by a cylindrical pin 183 and by a bottom web 184. The maneuvering member is also provided with a tab 185 allowing a user to exert an effort, represented by arrow $F_3$ in FIG. 5, tending to tilt the lock 16 about axes $X_1$ and $X_2$, in the direction of arrow $F'_1$ opposite to arrow $F_1$.

The lock 16 is provided with a housing 167 for receiving the pin 183, with possibility of rotation, while the web 184 is provided with a beak 186 intended to be engaged in a cavity 168 in the lock 16 oriented opposite the surface 161. In this way, once the pin 183 is in place in the housing 167, it is possible to pivot the member 18 about the geometrical axis $X_3$ of the pin 183 to immobilize the member 18 on the lock 16.

When the member 18 is in place on the lock 16, its plates 181 and 182 constitute two cheeks which isolate the volume V defined between the lock 16 and the arm 15 from the outside and in which the spring 17 and the pin 163 are disposed. In other words, the member 18 is an element for containment of the volume V which makes it possible to protect this volume against pollution and, in particular, against flock. The member 18 also makes it possible to retain within the volume V a lubricant such as grease, such a lubricant being able to be introduced in order to facilitate the articulation of the lock 16 on the arm 15.

Once the member 18 is clipped on the lock 16, an effort $F_3$ exerted by the user on the tab 185 has the effect of pivoting the lock 16, by its pin 163, into the cavity 151 against the effort $F_2$. This makes it possible to retract the lock 16 which attains the position of FIG. 5 where the surface 161 is disengaged from the path of the ring 4 during uncoupling of the frame 1 and the lever 11, the movement of the ring being represented by the arrow $F_5$.

In this configuration, the upper surface 169 of the lock 16 which connects the surface 161 to the part 165, is substantially aligned with the surface 144, this facilitating the slide of the ring 4 which is in abutment on this surface 169.

When it is desired to hook the frame 1 and the lever 11, it suffices to displace the ring 4 towards the housing 13, as represented by arrow $F_6$ in FIG. 1. The ring 4 then comes into contact with the surface 169 and pushes the lock against the effort $F_2$, this freeing passage for the ring 4.

As soon as the ring has arrived in housing 13, it ceases to interact with the lock 16 which is then pushed by the spring 17 towards the position of FIG. 3.

The invention presents the particular advantage that the lock 16, which presents a thickness e substantially equal to the thickness e' of the rest of the hook 10, is articulated on this hook without the use of a rivet likely to wear out prematurely. The mode of assembly of the member 18 on the lock 16 and of the lock 16 on the arm 15 provides for easy dismantling of these elements.

The invention has been shown with a ring presenting a substantially hexagonal section. The ring may, of course, be octogonal and, more generally, present any polygonal shape comprising two parallel surfaces for the transmission of effort between the lever and the ring, the other parts of the section of the ring being planar or curved, the geometry of the hook in that case being adapted thereto.

The invention has been shown with the ring fast with a heddle frame while the hook is fast with a drive lever. A reverse structure may, of course, be envisaged in which the ring is fast with a lever while the hook is fast with a heddle frame.

What is claimed is:

1. A device for connecting a heddle frame of a weaving loom to a lever actuated by a weaving mechanism of the weaving loom such that the lever is reciprocally movable in opposite directions along a line of movement, the device comprising:

a ring and a hook, said ring being connected about a first axis of articulation to one of the lever and the heddle frame and the hook being connected to the other of the lever and the heddle frame, said ring being substantially of polygonal cross section including at least two generally parallel outer surfaces which are cooperatively seated against at least two generally parallel bearing surfaces defined along an open housing of said hook when said ring is seated within said housing of said hook, said at least two generally parallel surfaces of said ring and said at least two generally parallel surfaces of said hook being orientated such that they are aligned to transmit forces along the line of movement of the lever caused by the reciprocal movement of a lever, a lock having a pivot portion pivotally mounted within a pivot cavity of said hook such that said lock is pivotal about a second axis of articulation relative to said housing of said hook, said lock including a surface for engaging said ring at a position between said first and second axes of articulation when said ring is seated within said housing of said hook, and said lock being substantially equal in width to a width of said ring.

2. The device of claim wherein said lock is made of self-lubricating steel.

3. The device of claim 1, wherein said lock and said hook define therebetween a volume for receiving a compression spring, said volume, defined by a thickness of said lock and said hook, being of variable size as a function of a relative position of said lock and said hook.

4. The device of claim 1 including a member for maneuvering said lock, said member being clipped on said lock and comprising a tab on which a force may be exerted for controlling pivoting of said lock with respect to said hook.

5. The device of claim 4, wherein said member for maneuvering defines an element for containment of a volume defined between said hook and said lock, said element for containment comprising two cheeks disposed on opposite sides of said hook and said lock.

6. The device of claim 5, wherein said member for maneuvering includes a pin extending between said cheeks and adapted to pivot in a cavity formed in a thickness of said lock.

7. The device of claim 4, wherein said member for maneuvering includes a beak for elastically clipping on a concave part of said lock oriented opposite a surface of said lock provided to face said ring.

8. The device of claim 1 including an element for containment of a volume defined between said hook and said lock, said containment element comprising two cheeks disposed on opposite sides of said hook and said lock.

9. The device of claim 1 wherein said ring includes a lubricator, said ring and said lubricator being made in one piece.

10. The device of claim 1 wherein said ring has an element in relief for indexing which cooperates with at least one plate of a pair of plates between which said ring is mounted, such that an angular clearance of said ring with respect to said pair of plates is limited.

11. A weaving loom including a heddle frame and a lever actuated by a weaving mechanism such that the lever is reciprocally movable along a line of movement and in opposite directions, a ring and a hook for selectively connecting said heddle frame to said lever, said ring being connected about a first axis of articulation to one of the lever and the heddle frame and the hook being connected to the other of the lever and the heddle frame, said ring being substantially of polygonal cross section including at least two generally parallel outer surfaces which are cooperatively seated against at least two generally parallel bearing surfaces defined along an open housing of said hook when said ring is seated within said housing of said hook, said at least two generally parallel surfaces of said ring and said at least two generally parallel surfaces of said hook being orientated such that they are aligned to transmit forces along the line of movement of the lever caused by the reciprocal movement of a lever, a lock having a pivot portion pivotally mounted within a pivot cavity of said hook such that said lock is pivotal about a second axis of articulation relative to said housing of said hook, said lock including a surface for engaging said ring at a position between said first and second axes of articulation when said ring is seated within said housing of said hook, and said lock being substantially equal in width to a width of said ring.

* * * * *